US006689214B2

(12) United States Patent
Burmester et al.

(10) Patent No.: US 6,689,214 B2
(45) Date of Patent: Feb. 10, 2004

(54) DEVICE FOR DISCHARGING A LIQUID

(75) Inventors: Thomas Burmester, Bleckede (DE); Jorg Steffens, Rullstorg (DE)

(73) Assignee: Nordson Corporation, Westlake, OH (US)

( * ) Notice: Subject to any disclaimer, the term of this patent is extended or adjusted under 35 U.S.C. 154(b) by 78 days.

(21) Appl. No.: 09/986,501

(22) Filed: Nov. 9, 2001

(65) Prior Publication Data

US 2002/0026897 A1 Mar. 7, 2002

Related U.S. Application Data

(63) Continuation of application No. PCT/EP00/04137, filed on May 9, 2000.

(30) Foreign Application Priority Data

May 10, 1999 (DE) ..... 299 08 150 U

(51) Int. Cl.[7] ..... B05C 5/00

(52) U.S. Cl. ..... 118/300; 118/323; 118/324; 118/325; 118/419; 427/434.2; 427/420; 427/207.1

(58) Field of Search ..... 118/300, 323–325, 118/419, 231, 257, DIG. 2, 410, 411; 427/434.2, 419, 420, 356, 207.1–208.8

(56) References Cited

U.S. PATENT DOCUMENTS

| | | | | | |
|---|---|---|---|---|---|
| 4,259,377 | A | * | 3/1981 | Baize | 427/346 |
| 4,687,137 | A | * | 8/1987 | Boger et al. | 239/124 |
| 5,305,955 | A | * | 4/1994 | Smitherman et al. | 239/75 |
| 5,575,851 | A | * | 11/1996 | Abe et al. | 118/410 |
| 5,674,319 | A | * | 10/1997 | Slobodkin | 118/411 |
| 5,843,230 | A | * | 12/1998 | Potjer et al. | 118/407 |
| 5,882,407 | A | * | 3/1999 | Takeno et al. | 118/419 |

* cited by examiner

*Primary Examiner*—Richard Crispino
*Assistant Examiner*—Michelle Acevedo Lazor
(74) *Attorney, Agent, or Firm*—Wood, Herron & Evans, L.L.P.

(57) ABSTRACT

An apparatus for applying fluid to a substrate which is movable relative to the apparatus. A slotted nozzle assembly of the apparatus communicates with a fluid supply and includes an elongated slot with an outlet aperture. The length of the slot may be varied using a stopper which can move in the slot and seal it off laterally. In another aspect, the entire slot can be shifted and fixed in the direction of the longitudinal axis of the slot using a guiding and adjusting device.

9 Claims, 5 Drawing Sheets

DEVICE FOR DISCHARGING A LIQUID

The present application is a continuation of PCT Serial No. PCT/EP00/04137 filed on May 9, 2000, published on Nov. 16, 2000, which claims the priority of German patent application No. 299 08 150.8, filed on May 10, 1999. The disclosures of each of these prior related applications are hereby fully incorporated by reference herein.

FIELD OF THE INVENTION

The present invention pertains to an apparatus for applying fluid to a substrate which is movable relative to the apparatus, in particular for applying adhesive to various substrates.

BACKGROUND OF THE INVENTION

Dispensing apparatus relevant to this invention are often referred to as applicator heads, and are used in various areas of industry in order to apply adhesives or other fluids to the surface of various substrates such as films, foils, or packaging materials. The applicator head may be mounted on a frame, and the substrate is typically moved past the applicator head by a transport device. In operation, the fluid may discharge from an elongate outlet aperture of a slot.

JP 05200346 (patent abstracts of Japan) describes a slotted nozzle coating apparatus with a slot for emitting coating material. The width of the slot can be adjusted on both sides by introducing so-called stoppers.

To vary the length of the slot in the slotted nozzle assembly and thereby vary the width of adhesive or other fluid application, it has been suggested that movable stoppers be placed on both lateral end sections of the slot, which can be shifted in the slot and held in various positions which limit the slot laterally. In this way the width of fluid application can be reduced on both sides, starting from a maximum fluid application width.

There is still a need for a fluid dispensing apparatus of this general type which has a more efficient and easily used design to provide for variation of the application width and adaptation to various application conditions.

SUMMARY OF THE INVENTION

The invention uses a simple design not only to enable varying the length of the slot in the slotted nozzle assembly, but also to shift the entire application head if needed, in order to be able to align the application head precisely in reference to various substrates which are transported past it. The apparatus in accordance with the invention has several adjustment options. By sliding the entire main body in the direction of the longitudinal axis of the slot and at the same time shifting the stopper in the same direction, the width of application remains constant and the slotted nozzle assembly is shifted together with the application head relative to a substrate while the length of the slot remains constant, so that the width of application remains the same and the slotted nozzle assembly can be positioned exactly with respect to the substrate. Alternatively, the slotted nozzle assembly can be shifted by using a guiding and adjusting device, while the stopper which is positioned movably in the slot and seals it laterally does not change its position, relative to a fixed-position frame of a production facility, but only changes its position relative to the slotted nozzle assembly of the application head. The length of the slot is reduced in this case and one lateral margin of the slot changes its position relative to the substrate. Alternatively, the stopper which is movable within the slot can be moved in the slot with the help of an adjusting device, while the main body remains stationary relative to a fixed-position frame, so that the length of the slot is varied and one lateral end section of the slot changes its position while the other end section of the slot retains its position.

The apparatus in accordance with the invention thus makes much more varied adjustment of the width of the slot and position of the slot possible relative to a substrate, compared to the state of technology. The two lateral margins of the slot can be varied and the entire slotted nozzle assembly can be moved.

A preferred implementation of the invention is distinguished by the fact that the guiding and adjusting device has several linear guides, preferably having rollers, so that simple shifting is possible with little force and a rigid arrangement of the application head is assured when it is in its fixed state.

In an especially preferred way, the guiding and adjusting device is designed with a rotatable threaded spindle and a threaded piece located on the main body and engaging the threaded spindle, so that reliable and precise adjustment is possible with simple design. Alternatively, a ball screw spindle could be used. It is useful for the threaded spindle to be coupled with a hand wheel for manually moving the main body, whereby simple and precise repositioning is possible.

According to an alternative preferred implementation, the stopper, which can move in the slot, is rigidly connected to a piston which is positioned movably and sealed in a distribution passage which communicates with the slot. It is useful for the stopper and the piston to be movable by means of a shared slot adjusting device. With the help of the piston which is positioned movably in the distribution passage and the stopper, the distribution passage is varied laterally—together with the slot length. Furthermore, fluid is fully squeezed out of the distribution passage, so that no fluid residues collect, a factor which is especially important when processing adhesives. Furthermore, with the help of the piston and the stopper the apparatus can be cleaned and adhesive can be pressed out of the slot and the distribution passage when operation is interrupted for an extended time, so that no hardening of the adhesive occurs.

A refinement of the invention is designed with the adjusting device having a threaded spindle mounted so that it can turn, and a threaded sleeve which is rigidly connected to the piston and engages the threaded sleeve. Preferably the threaded spindle of the adjusting device is coupled with a hand wheel for manual adjustment.

Especially simple handling of the application head in accordance with the invention is achieved by having the hand wheel of the guiding and adjusting device and the hand wheel of the slot adjusting device positioned parallel, side-by-side on one side relative to the main body and the threaded spindles, since the guiding and adjusting device for the main body and the slot adjusting device can be operated from one side, even while the device is in operation during application.

According to a refinement there is a substrate guiding device, having a frame which can be caused to rotate on the main body by means of a pneumatic cylinder and two elongated guide elements mounted on the frame parallel to the slot, and the guide elements for their part are arranged so that they can be rotated or fixed jointly relative to the frame.

Because the frame can be rotated relative to the main body on the one hand, and because on the other hand the two guide elements which are in contact with the substrate are arranged so that they can be fixed or rotated relative to the frame, in operation the substrate is positioned optimally relative to the outlet aperture of the slot in the slotted nozzle assembly and guided past it so that optimal application of fluid is achieved. In an especially simple design, the guide elements are designed as guide rods with a polished surface. Alternatively, the guide elements could be constructed as rotatable shafts in order to reduce the friction.

BRIEF DESCRIPTION OF THE DRAWINGS

These and other objects, advantages, and features of the invention will become more readily apparent to those of ordinary skill in the art upon review of the following detailed description of the preferred embodiments, taken in conjunction with the accompanying drawings.

DETAILED DESCRIPTION OF THE PREFERRED EMBODIMENT

Apparatus 1 shown in the figures applies fluid on a substrate (not shown) which is movable relative to the apparatus 1. Typically, the substrate may comprise sheets of film or foil which are transported past the apparatus 1. Of course the surfaces of other substrates could also be coated, such as packaging material or other materials.

Figure 1:
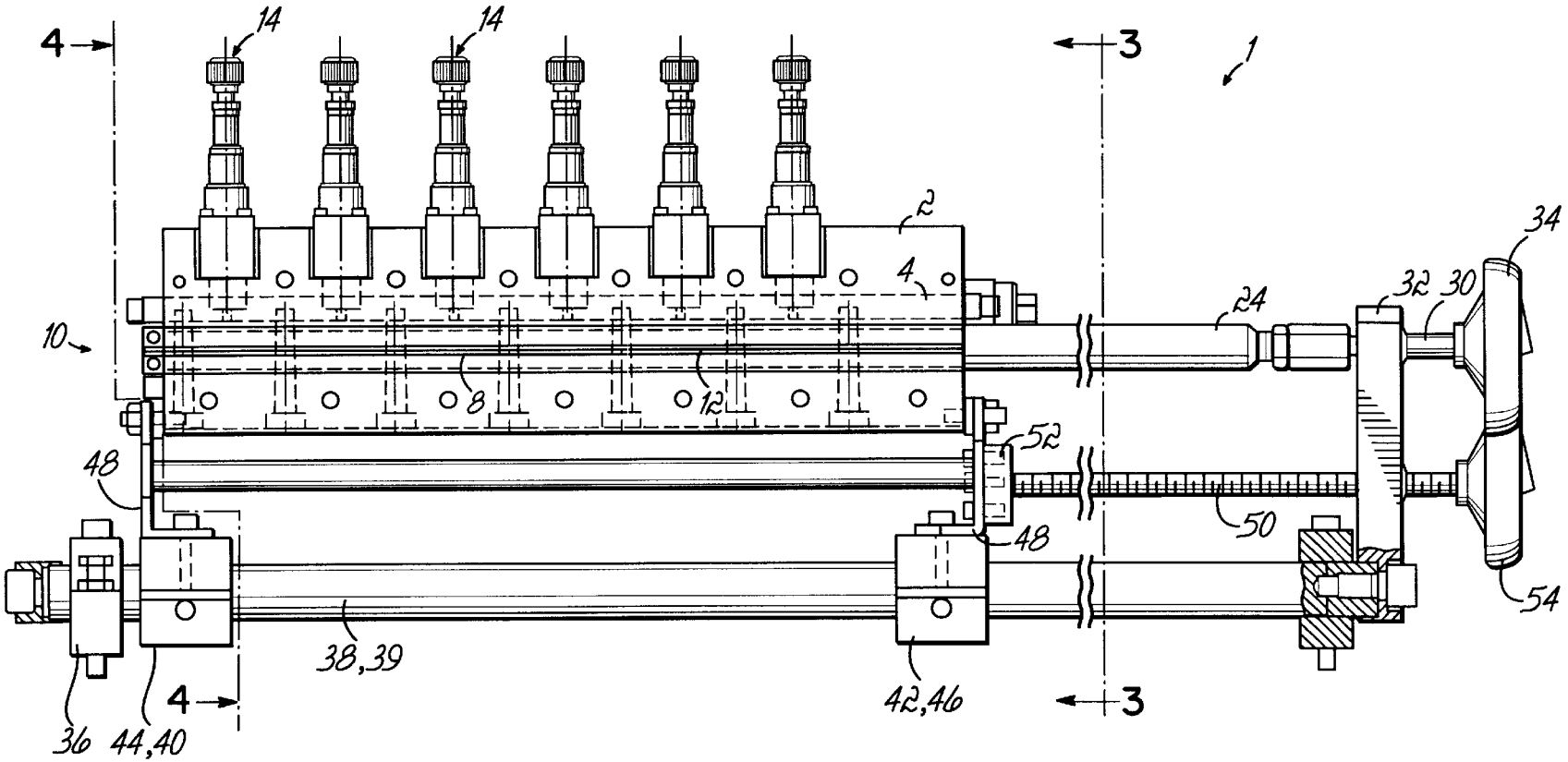
FIG. 1 is a side view of an illustrative apparatus in accordance with the invention for applying adhesive.

Referring to FIG. 1, Apparatus or applicator head 1 has a main body 2 and a fluid supply passage 4 which can be connected to a source of adhesive (not shown). The fluid supply passage 4 can be in the form of a cylindrical hole bored in the main body 2 and is supplied with fluid, such as adhesive, through a supply passage, such as in a flexible adhesive line (not shown). The main body can have an upper part 3 and a lower part 5 which are threaded together. There is a cylindrical distribution passage 6 inside the main body 2, which like the fluid supply passage 4 extends the entire length of the applicator head 1. The distribution passage 6 is formed half as a semi-cylindrical recess in the upper part 3 and the other half as a semi-cylindrical recess in the lower part 5, so that the distribution passage 6 can easily be cleaned other shapes may be used instead. The distribution passage 6 communicates with a horizontal slot 8 in a slotted nozzle assembly 10. The slot 8 opens into an elongated outlet aperture 12, from which adhesive flows during operation and is then transferred to the substrate.

Above the fluid supply passage 4, attached to the main body 2, there are six application valves 14 for selectively stopping and starting the flow of adhesive from the fluid supply passage 4 into the distribution passage 6 and thus through the slot 8. Of course, other manners of controlling the fluid flow may be used instead. In this implementation example, and as those of ordinary skill will understand, each application valve 14 is designed as a pneumatically operable valve and has a needle 16 which is coupled with a pressurized gas piston that is positioned for movement in a cylinder, and can be moved up and down when pressure differences are applied to the piston. The lower section of the needle 16 interacts with a valve seat which is formed on the main body 2. In the immediate vicinity of the valve seat, between the fluid supply passage 4 and the distribution passage 6, there is a vertical connecting hole, which is closed by the point of the needle 16 when the application valve is in the closed position and is open when the needle 16 is in the open position. Each application valve 14 has a connecting hole associated with it. In a manner which is not shown, the application valves 14 are connected to pressurized gas lines.

Figure 2:
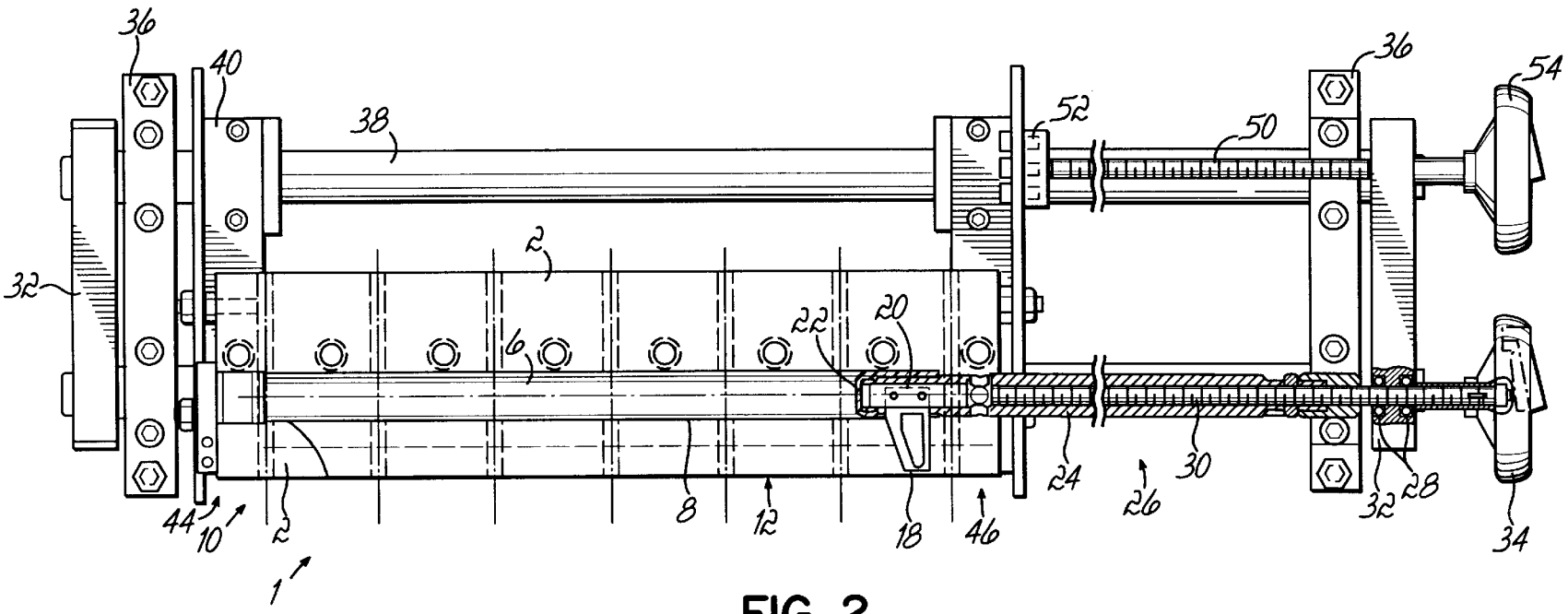
FIG. 2 is a top view of the apparatus from FIG. 1 partially sectioned to show certain inner details.
Figure 3:
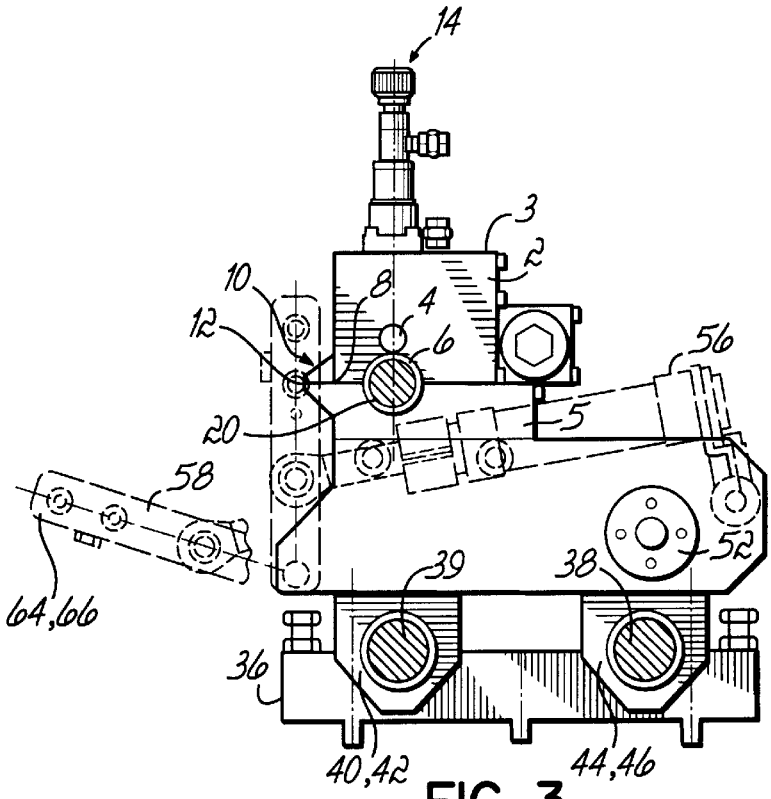
FIG. 3 is a side view of the apparatus taken along line 3—3 of FIG. 1.
Figure 4:
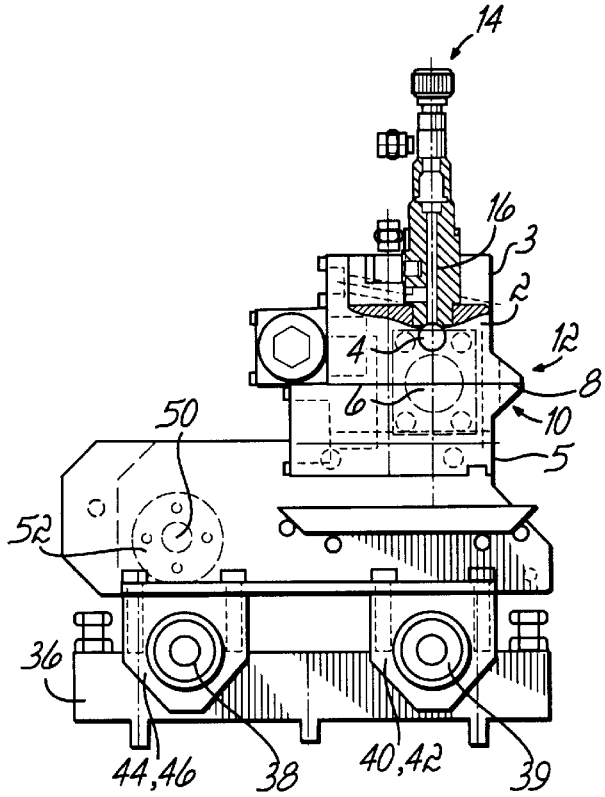
FIG. 4 is another side view of the apparatus taken along line 4—4 of FIG. 1.
Figure 5:
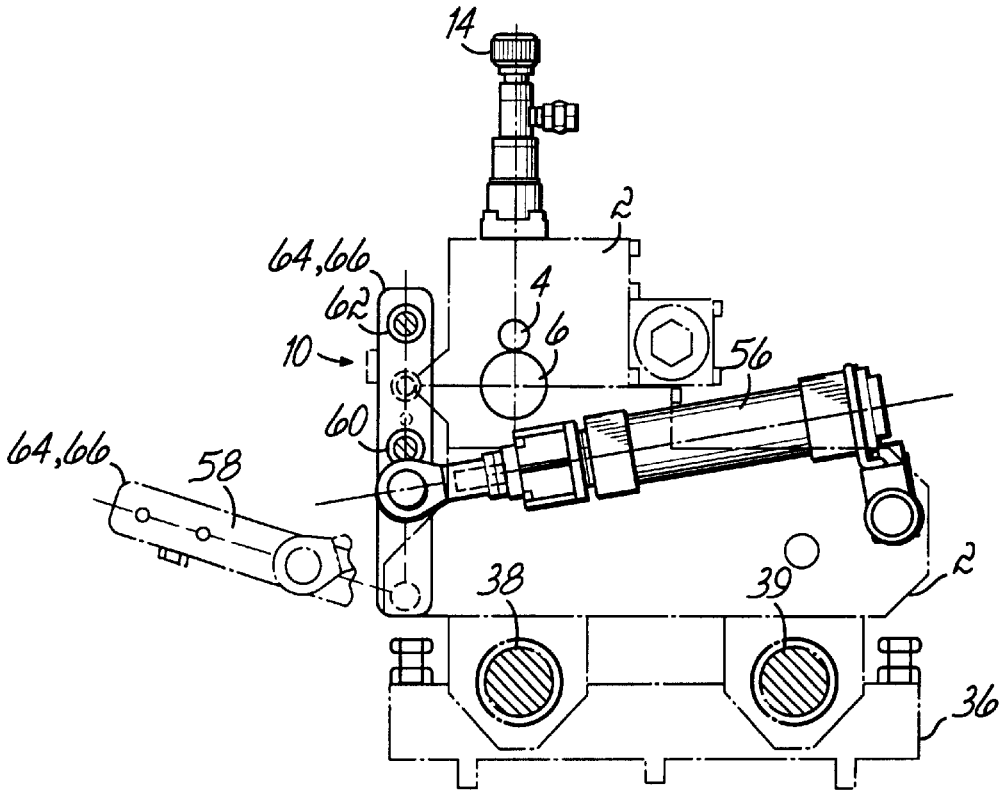
FIG. 5 is a side view of part of the apparatus in accordance with the invention.
Figure 8:
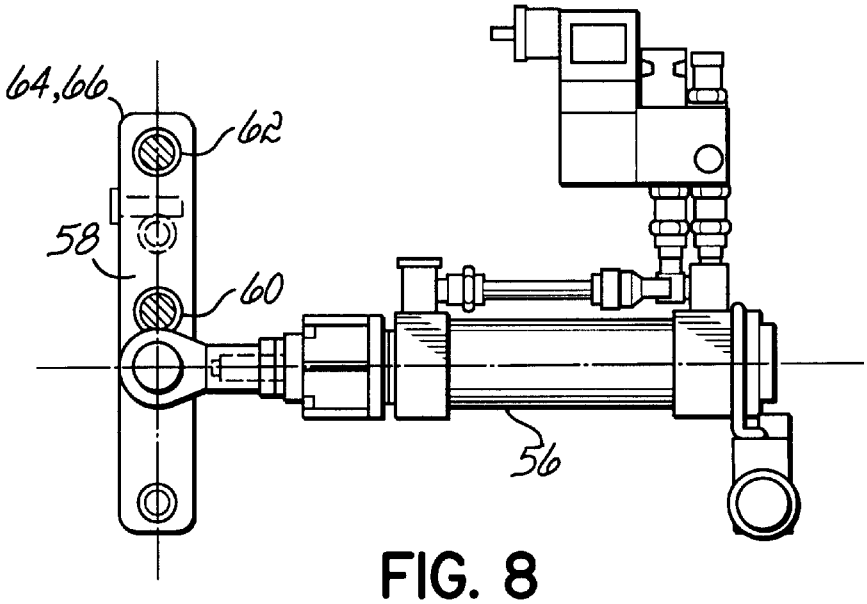
FIG. 8 is another side view of the substrate guiding device.
Figure 6:
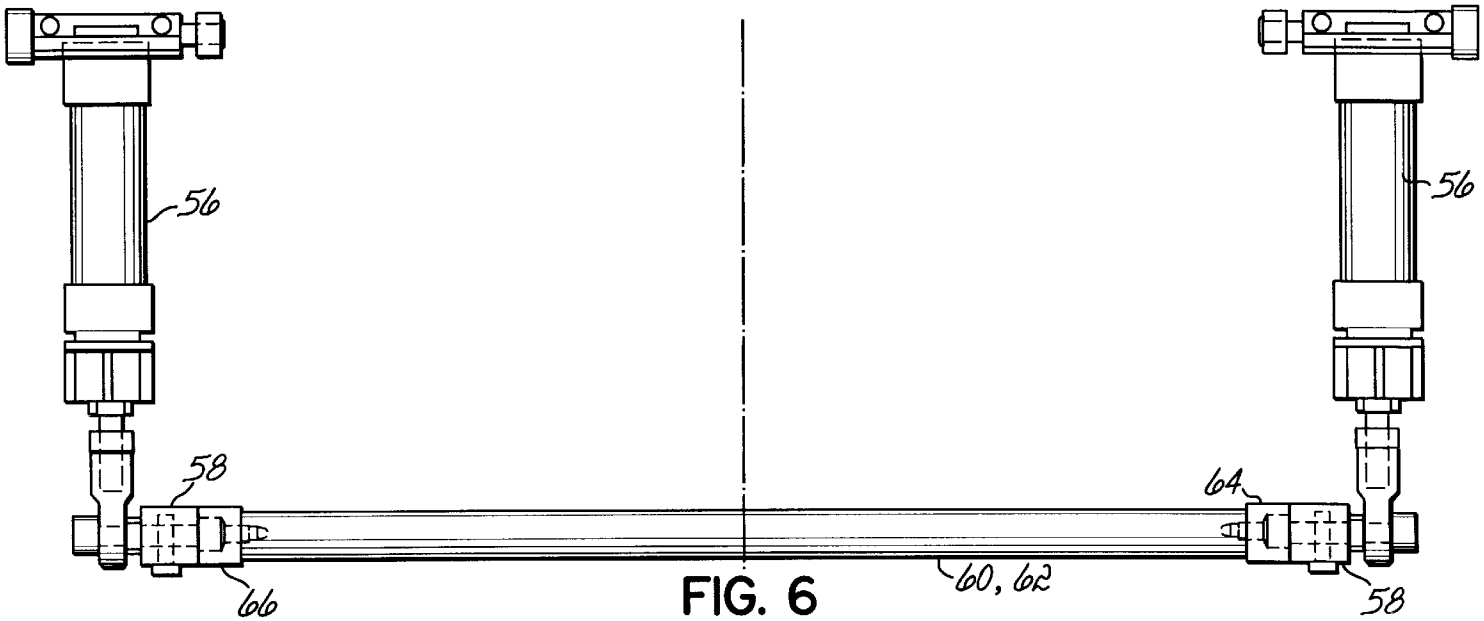
FIG. 6 is a top view of a substrate guiding device.
Figure 7:
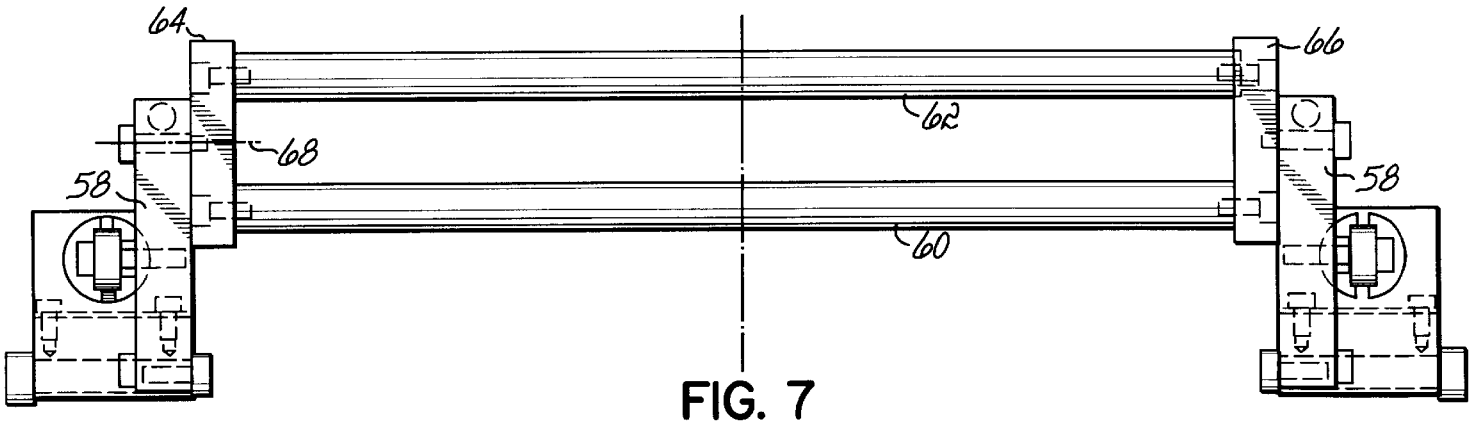
FIG. 7 is a side view of the substrate guiding device from FIG. 6.

As FIGS. 2 and 3 illustrate, a stopper 18 is positioned movably in the slot 8 of the slotted nozzle assembly 10 and seals off the slot 8 laterally. The stopper 18 is rigidly coupled with a cylindrical piston 20, which is axially movable within the distribution passage 6. The stopper 18 extends from the piston 20 to the outlet aperture 12 of the slotted nozzle assembly 10. The piston 20 has an outer jacket 22, which is attached to a threaded sleeve 24.

The threaded sleeve 24 is part of an adjusting device 26, for varying the length of the slot 8 by shifting the stopper 18 in the slot 8 together with the piston 20 in the distribution passage 6. The adjusting device 26 also has a threaded spindle 30 which is mounted by two ball bearings 28 so that it can rotate. Male threads of spindle 30 engage female threads of the threaded sleeve 24. The ball bearings 28 are set into a plate 32. Attached to the end of the threaded spindle is a hand wheel 34 for manually turning and adjusting the adjusting device 26. Turning the hand wheel 34 rotates the threaded spindle 30, causing the threaded sleeve 24, the piston 20 and the stopper 18 to be moved axially in the direction of the longitudinal axis of the slot 8 and of the distribution passage 6, so that depending on the direction in which the hand wheel 34 is turned the length of the slot—viewed in the longitudinal direction of the application head 1—is reduced or increased, and thus is variable. Those of ordinary skill will recognize that other mechanisms may be used to provide axial movement of such a stopper 18.

The main body 2, and with it the entire application head 1, is mounted so that it can be moved back and forth relative to a fixed-position frame in the direction of the longitudinal axis of the slot 8 of the slotted nozzle assembly 10 and fixed in different positions by a guiding and adjusting device. The guiding and adjusting device has two supports 36 which can be attached to a frame of a production apparatus (not shown) and attached to them two mutually parallel cylindrical guide rods 38, 39, and surrounding the guide rods 38, 39 the linear guides 40, 42, 44, 46; these have several rollers which roll along the guide rods 38, 39. The lower section of the main body 2 is screwed together with the linear guides 40, 42, 44, 46. That enables the main body 2 to move linearly along the longitudinal axes of the guide rods 38, 39. The guide rods 38, 39 have their end sections connected to the supports 36 by screws, as shown in FIG. 1. The linear guides are screwed to the main body 2 of several angle sections.

The guiding and adjusting device also has a threaded spindle 50 with male threads which is mounted in the plate 32 with ball bearings so that it can rotate, as well as a threaded piece with female threads which is engaged with the male threads of the threaded spindle 50 and is screwed to an angle section 48 (see FIG. 1). Turning a hand wheel 54 which is coupled with the threaded spindle 50 causes the main body 2 and thus the entire application head 1 to move back and forth linearly depending on the direction of rotation of the hand wheel 54. The maximum travel displacement depends on the length of the guide rods 38, 39. The main body 2 is fixed in any position desired by the friction between the male threads of the threaded spindle 50 and the female threads of the threaded piece 52. The hand wheels 34 and 54 and the threaded spindles 30 and 50 are positioned on one side relative to the main body 2, so that they can be operated simply from one side in order to vary the length of the slot 8 and the position of the main body 2, and thus of the application head 1.

FIGS. 3 to 8 illustrate a substrate guiding device for transporting a sheet of film or foil or the like past the outlet aperture 12 of the slotted nozzle assembly 10 along a defined travel path. The substrate guiding device has a frame 58 which is mounted on the main body 2 so that it can be rotated by two pneumatic cylinders 56, and two parallel guide elements 60, 62 with a space between them, designed as guide rods with a polished surface, which can be rotated simultaneously and fixed in various rotated positions.

The two guide rods 60, 62 are mounted by their end sections on two plates 64, 66, which can be rotated around a rotational axis 68 (see FIG. 7) relative to the frame 58. It can be seen from FIGS. 3 and 5 that the frame 58, the plates 64, 66 and the guide elements 60, 62 can be rotated with the help of the pneumatic cylinder 56 from a first diverted position to a second operating position, and the substrate can be moved past the outlet aperture 12 by adjusting the rotational position of the plates 64, 66 and fixing them with screws in an optimal position for guiding the substrate according to the needs of the application. Alternatively, instead of the guide elements 60, 62 there can be a pressure roller opposite the outlet aperture 12.

While the present invention has been illustrated by a description of a preferred embodiments and while these embodiments have been described in some detail, it is not the intention of the Applicants to restrict or in any way limit the scope of the appended claims to such detail. Additional advantages and modifications will readily appear to those skilled in the art. The various features of the invention may be used alone or in numerous combinations depending on the needs and preferences of the user. This has been a description of the present invention, along with the preferred methods of practicing the present invention as currently known. However, the invention itself should only be defined by the appended claims, wherein.

We claim:

1. An apparatus for applying fluid to a substrate, comprising:

a main body having a fluid supply passage and a fluid distribution passage;

a slotted nozzle assembly operatively coupled to said main body and having an elongate slot in fluid communication with said fluid distribution passage, said slot including a length along which the fluid is dispensed;

a plurality of application valves mounted to said main body and regulating flow of the fluid from said fluid supply passage to said fluid distribution passage;

a stopper mounted for movement in said slotted nozzle assembly to laterally seal off a portion of said fluid distribution passage and said slot to vary the length along which the fluid is dispensed; and a guiding and adjusting device operatively coupled to said main body to allow said main body, said slotted nozzle assembly, and said plurality of application valves to be moved and fixed in a direction extending along the length of said slot for aligning the length along which fluid is dispensed relative to the substrate.

2. The apparatus of claim 1, wherein said guiding and adjusting device includes a plurality of linear guides attached to said main body and a plurality of guide rods engaged with said linear guides, said main body moving along said linear guide rods and guided by said linear guides.

3. The apparatus of claim 1, wherein said guiding and adjusting device includes a first threaded member and said main body includes a mating second threaded member, and said main body is moved by rotating one of said first and second threaded members with respect to the other of said first and second threaded members.

4. The apparatus of claim 3, wherein said first threaded member includes a manually rotatable portion for rotating said first threaded member and moving said main body.

5. The apparatus of claim 1, further comprising a piston positioned in and movable along said fluid distribution passage, wherein said stopper is operatively coupled to said piston.

6. The apparatus of claim 5, further comprising a slot adjusting device operatively coupled to said stopper and said piston, said slot adjusting device operative to move both said stopper and said piston.

7. The apparatus of claim 6, wherein said slot adjusting device further comprises mating threaded portions operative to move both said stopper and said piston.

8. The apparatus of claim 7, further comprising a manually operative member for rotating one of said threaded portions.

9. The apparatus of claim 1, further comprising:

a substrate guiding device operative to guide a moving substrate past said slotted nozzle assembly, said substrate guiding device including a frame configured to be rotated relative to said main body and a pair of guide elements extending parallel to said slot and operating to guide the substrate past said slotted nozzle assembly.

* * * * *